US006514081B1

(12) United States Patent
Mengoli

(10) Patent No.: US 6,514,081 B1
(45) Date of Patent: Feb. 4, 2003

(54) METHOD AND APPARATUS FOR AUTOMATING MOTION ANALYSIS

(76) Inventor: Jeffrey L. Mengoli, 2 Townsend St., #1-600, San Francisco, CA (US) 94107

( * ) Notice: Subject to any disclaimer, the term of this patent is extended or adjusted under 35 U.S.C. 154(b) by 91 days.

(21) Appl. No.: 09/632,381

(22) Filed: Aug. 3, 2000

Related U.S. Application Data

(60) Provisional application No. 60/147,352, filed on Aug. 6, 1999.

(51) Int. Cl.[7] ..... A63B 69/36

(52) U.S. Cl. ..... 434/252; 434/307 R; 434/428; 473/266

(58) Field of Search ..... 434/350, 247, 434/252, 257, 258, 131, 327, 118, 119, 307 R; 473/266, 409, 199, 201, 202; 273/183, 186, 35; 364/550, 551, 559

(56) References Cited

U.S. PATENT DOCUMENTS 5,111,410 A 5/1992 Nakayama et al.
5,249,967 A 10/1993 O'Leary et al.
5,333,061 A 7/1994 Nakashima et al.
5,486,001 A 1/1996 Baker
5,797,805 A 8/1998 Lubell et al.
5,826,578 A * 10/1998 Curchod ..... 434/252
5,904,484 A 5/1999 Burns
6,293,802 B1 * 9/2001 Ahlgren ..... 434/252

* cited by examiner

*Primary Examiner*—John Edmund Rovnak
*Assistant Examiner*—John Sotomayor
(74) *Attorney, Agent, or Firm*—William L. Paradice, III

(57) ABSTRACT

A pre-recorded video of a master's swing motion is stored as first frame sequences in computer memory. Target cues indicative of motion progress are associated with each first frame sequence. A video recording of the student performing the swing motion is stored in computer memory as second frame sequences. Reference cues indicating motion progress of the student are inserted into or associated with each student frame. The first frames are aligned with and normalized to the second frames, and then the first frames are synchronized to corresponding second frames using the target cues and the reference cues. The corresponding first and second frame pairs are superimposed, and immediately thereafter displayed to allow the student to analyze differences between his swing motion and the master's swing motion.

53 Claims, 9 Drawing Sheets

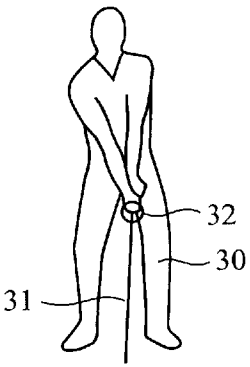
FIG. 3A
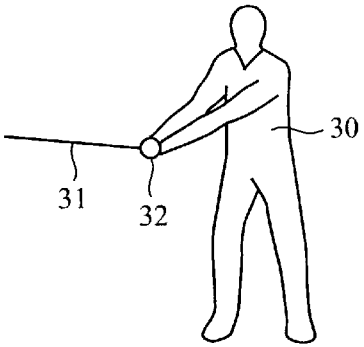
FIG. 3B
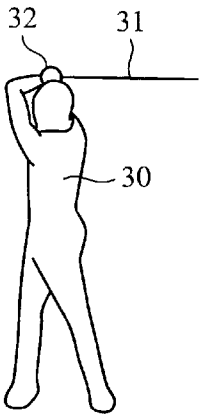
FIG. 3C
FIG. 3D
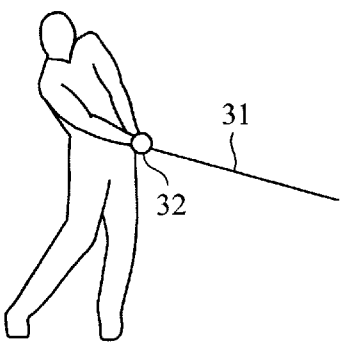
FIG. 3E
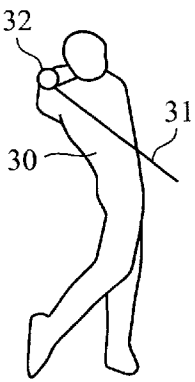
FIG. 3F

METHOD AND APPARATUS FOR AUTOMATING MOTION ANALYSIS

CROSS-REFERENCES TO RELATED APPLICATIONS

This application is based upon the provisional patent application entitled "Method for Automating Motion Analysis", having Ser. No. 60/147,352 and filed on Aug. 6, 1999, incorporated by reference herein.

BACKGROUND

1. Field of Invention

This invention relates generally to motion analysis and specifically to a method for comparing a student's motion to that of a master in a particular sport such as golf.

2. Description of Related Art

Form and body position are essential to mastering many sports. For example, in golf, proper positioning of the head, hands, and golf club is necessary for a good golf swing. Thus, players wishing to improve their performance often enlist a professional to analyze their technique and offer advice for correcting the player's position and motion. In addition, there are a number of video training systems available to aid a player in practicing his golf swings. Typically, these systems superimpose a video image of a student practicing his swing over a video template of a master executing a desirable golf swing so that differences between the student's swing and the master's swing can be discerned.

For example, one type of training system is disclosed in U.S. Pat. No. 5,333,061 to Nakashima et al in which recorded video images of the student's swing are converted into still pictures and superimposed over corresponding pictures of a master's swing consisting of a series of lines connecting various points on the master's body and club. The resulting pictures are then recorded onto a videotape, and additional visual and/or audio information can then be added to the videotape. Although the resultant superimposition of the student's swing over the master's swing is beneficial, the process of making the training video tape is lengthy and, thus, fails to provide immediate feedback to the student. Typically, the video tape is made some time after the student's swing is recorded, and the student subsequently views the training video in a VCR, for instance, at home. The time delay between the student practicing his swing and viewing the training video often reduces the effectiveness of feedback.

Other systems allow a student to compare his swing with a master's swing in real time. For example, in U.S. Pat. No. 5,904,484, O'Leary et al use a video overlay generator to produce a static image representing the dynamic technique of a master, and overlay the live image of the student for a simultaneous display on a visual monitor. While watching the overlying image of the master, the student attempts to execute his swing so as to maintain his image in alignment with the image of the master. Another interactive real time training system is disclosed in U.S. Pat. No. 5,904,484 to Burns and allows a student to interactively emulate in real time the dynamic motion of a master performing a selected motion on a monitor simultaneously displaying the student in real time.

Although allowing for real time comparisons to a master, these techniques undesirably require the student to practice the selected motion while simultaneously watching a video monitor. It may be difficult and/or distracting for the student to completely concentrate on his swing motion while watching a video monitor. Further, requiring the student to watch the video monitor may preclude proper positioning and orientation of the head during, for example, a golf swing. Moreover, requiring the student to watch the video monitor may preclude other critical elements of the motion, for example, hitting a ball in a golf swing or baseball swing. Therefore, it would be desirable to provide substantially immediate comparison feedback to a student practicing a swing motion without requiring the student to watch a monitor while practicing the swing motion.

SUMMARY

A method and apparatus are disclosed that allow a student to receive immediate analysis of a swing motion such as a golf swing without having to watch a video monitor while performing the swing motion. In accordance with the present invention, a pre-recorded video of a master's swing motion is stored as a plurality of first frame sequences in computer memory. Target cues indicative of motion progress of some indicia, such as the master's wrists, are associated with each first frame sequence. A video recording is made of the student performing the swing motion, and stored in computer memory as a plurality of second frame sequences. References cues indicating motion progress of using the same indicia as used for the master, e.g., the student's wrists, are inserted into or associated with each student frame. In some embodiments, the reference cues are generated by a processor. In other embodiments, the reference cues are generated manually by tracing a motion path of the indicia using, for example, a mouse or touchpad. In one embodiment, the student wears a magnetic glove or other device that allows the student's wrist to be tracked throughout the swing motion. After the master frames are aligned with and normalized to the student frames, the master frames are synchronized to corresponding student frames using the target cues and the references cues for synchronization. The corresponding master and student frame pairs are superimposed, and displayed as a motion video on a video monitor to allow the student to analyze differences between his swing motion and the master's swing motion.

The ability to record the student's video, synchronize it to a master's video, and immediately display the resultant superimposed video to the student provides students with immediate analysis of their golf swing. Unlike prior devices, the present invention does not require the student to look at a video monitor while executing his golf swing in a manner to emulate a master's swing, thereby allowing the student to concentrate on executing his swing in a normal manner. Further, since present embodiments provide the superimposed, feedback video directly from computer 11, without having to a make a video tape recording, the student receives immediate, on the spot feedback. Thus, after analyzing his swing, the student may immediately record and analyze another swing. This is in contrast to prior training systems that result in the production of a training video tape which typically must be later viewed by the student in a VCR, perhaps at home.

BRIEF DESCRIPTION OF THE DRAWINGS

FIGS. 3A–3F illustrate representative frames of an outline of a master's swing motion at various intervals;

Like reference numerals refer to corresponding parts throughout the drawing figures.

DETAILED DESCRIPTION

The present invention is utilized for training motion used in various sports, and is particularly useful for improving a student's motion sequence in an activity where proper form and body positioning are essential to mastering the activity. Thus, although described below in the context of improving a student's golf swing, the present invention is equally applicable to improving swings or motion sequences in other sports or activities such as baseball, tennis, basketball, dance, etc. In addition, the present invention is applicable for analyzing motion for mechanical devices, e.g., robotic devices. Accordingly, the present invention is not to be construed as limited to specific examples described herein but rather includes within its scope all embodiments defined by the appended claims.

Figure 1:
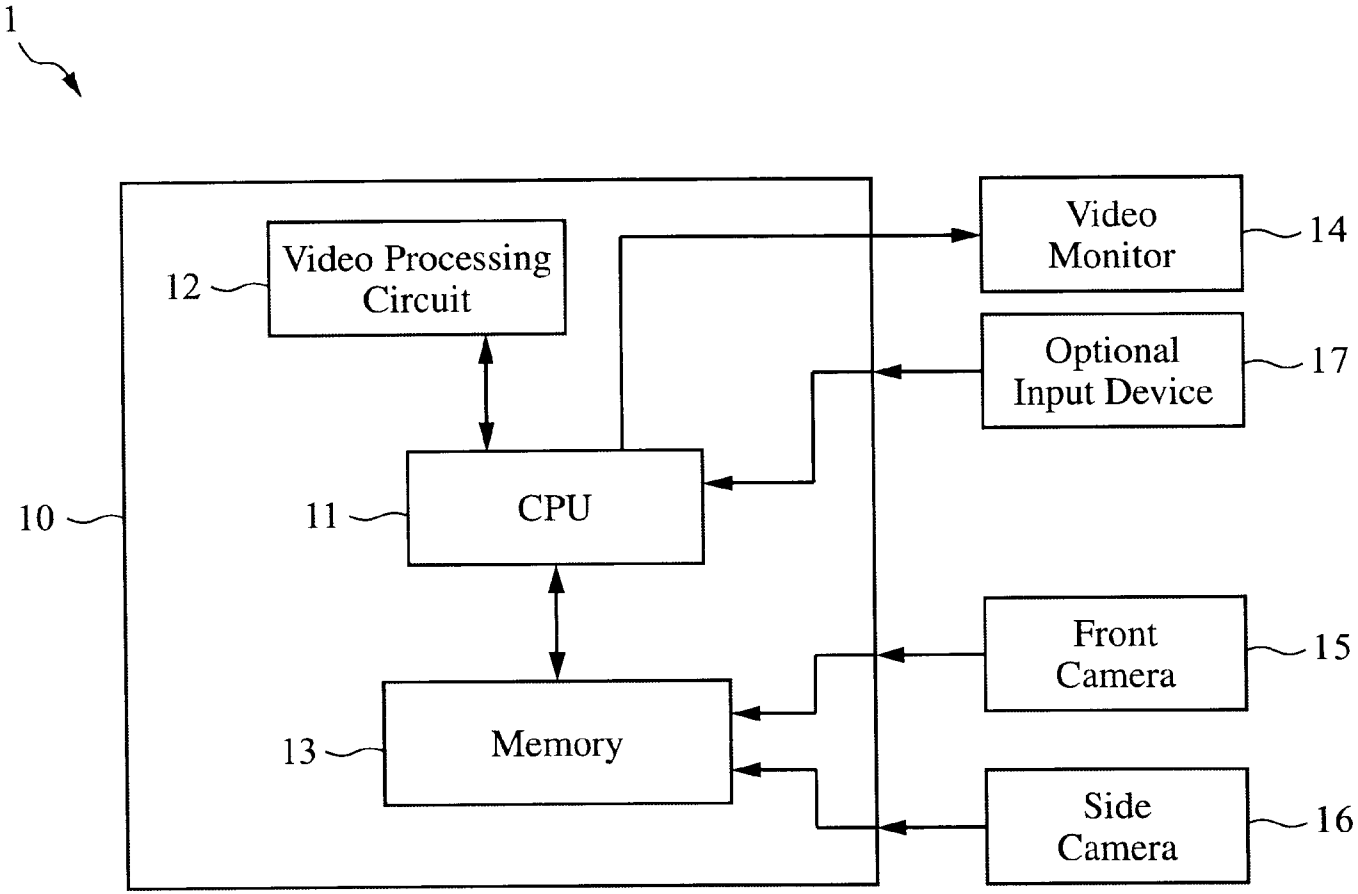
FIG. 1 is a block diagram of a computer system configured in accordance with the present invention.
Figure 2:
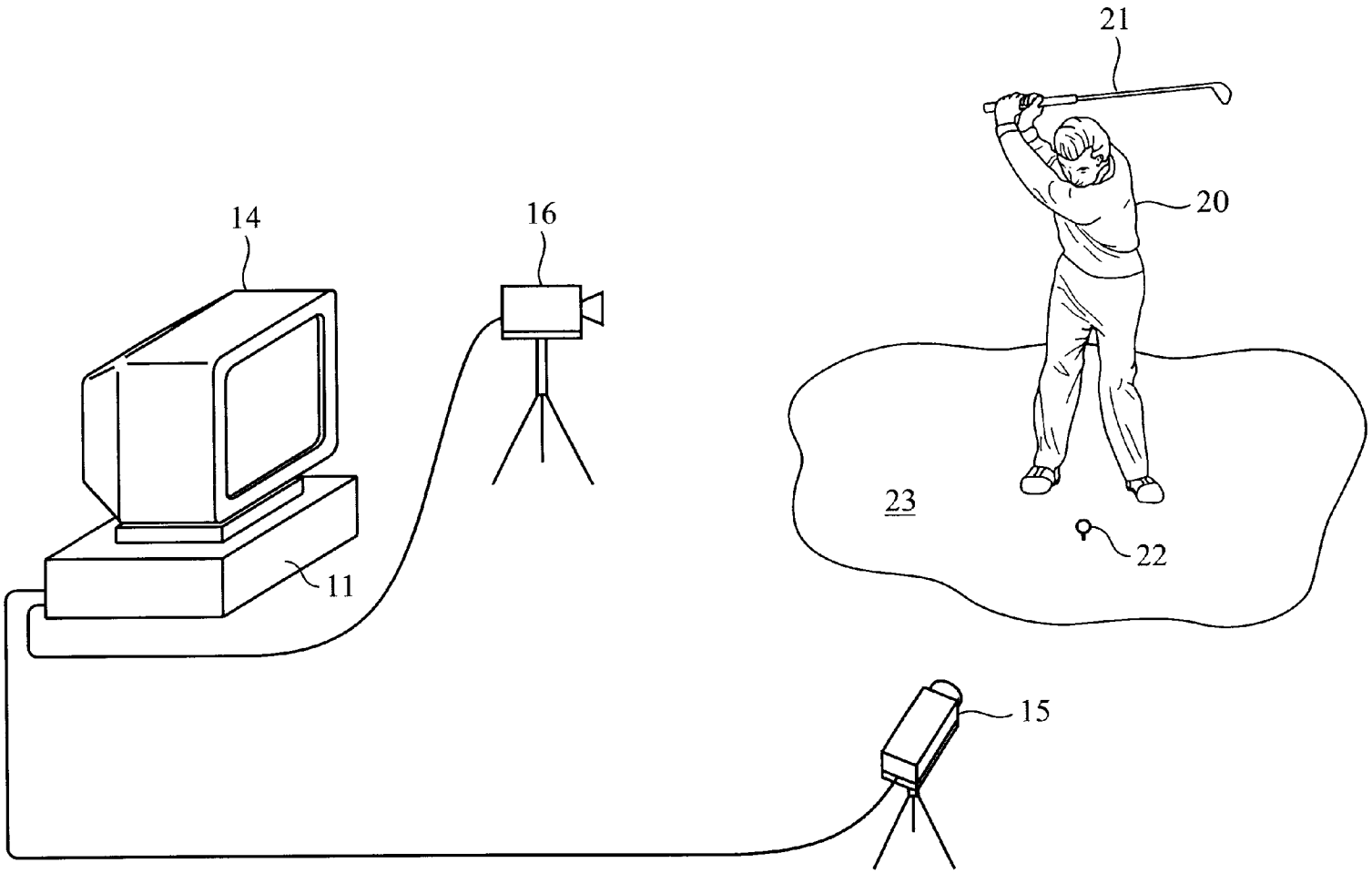
FIG. 2 is a perspective view of the computer system of FIG. 1 utilizing video cameras to provide live images from multiple viewing angles.

A motion analysis system 1 in accordance with one embodiment of the present invention is shown in block form in FIG. 1 and in perspective form in FIG. 2. System 1 includes a computer 10 having a central processing unit (CPU) 11, a video processing circuit 12, and main memory 13. Computer 10 may be a standard personal computer (PC). CPU 11 may be any well-known CPU such as, for instance, a Pentium model processor available from Intel Corporation of Santa Clara, Calif. Computer 10 is configured to run on the Windows Operating System available from Microsoft Corporation of Redmond, Washington, although other operating systems may be used. Video processing circuit 12 captures and processes digital images of the recorded video of a student 20's golf swing received from cameras 15 and 16 according to instructions received from CPU 11. Main memory 13 may be any-well known memory such as DRAM. An optional input device or devices 17, such as a keyboard, mouse, touchpad, and/or electronic stylus, may also be connected to computer 10. Other well-known features of computer 10, such as a hard drive, floppy disk drives, a CD-ROM player, and so on, are omitted for simplicity.

A "front" camera 15 is coupled to a first video input port of computer 10, and is positioned to record the front view of a student 20 swinging a golf club 21 to hit a golf ball 22. A "side" camera 16 is coupled to a second video input port of computer 10, and is positioned to record the side view of the student 20's golf swing motion. Cameras 15 and 16 may be any suitable video recording devices. Preferably, cameras 15 and 16 are high resolution and are able to capture at least 30 frames per second when recording. Although cameras 15 and 16 are shown in FIGS. 1 and 2 as providing separate front view and side view signals to computer 11, some embodiments include a well-known splitter/merger circuit (not shown) that converts the two signals received from cameras 15 and 16 into a single video stream to be received into computer 11. In other embodiments, only one of cameras 15 and 16 are provided. In still other embodiments, a third camera (not shown for simplicity) may be provided on the opposite side of the student from side camera 16, e.g., viewing the swing motion from the direction in which the ball would be hit.

Memory 13 stores one or more video files recording front and side views of the swing motions of one or more masters. The computer files of the masters' swing motions may be stored in the well-known WAV video format, although other video formats may be used. FIGS. 3A–3F are 6 representative frames at various points along a complete sequence of the golf swing motion of a master 30 stored in memory 13. The master 30 is shown executing his swing motion in outline form taken from a front view camera. Only 6 frames are shown in FIGS. 3A–3F for simplicity; in actual embodiments, the video recording of the master's swing motion may include 40 or more frames.

Specifically, FIG. 3A illustrates the master 30 addressing a golf ball (not shown) with a golf club 31 at the start of a golf swing motion sequence. FIG. 3B illustrates the master 30's outline starting a backswing motion by drawing the club 31 away from the ball. The backswing of the club 31 continues through FIG. 3B until the recorded image of the master 30 reaches the top of the backswing in FIG. 3C. FIGS. 3D and 3E show the downswing of the club 31 through completion of the golf swing motion in the final representative frame of the motion sequence in FIG. 3F.

The outline of master 30 includes target cues 32 identifying relative positional movements of master 30 during the swing motion. As explained below, target cues 32 are used to synchronize the master 30's swing to the student 20's swing. Preferably, target cues 32 highlight the movement and relative position of the master 30's wrists during his swing motion. For example, in one embodiment, a software program executing on CPU 11 associates a target cue 32 for each representative frame shown in FIGS. 3A–3F to indicate the master's relative wrist position during his swing. In actual embodiments, the target cues 32 may not be inserted into the video frames as depicted in the drawings, but rather stored as synchronization data which may later be used to synchronize the master's swing to the student's swing. The master's outline 30 may be adjusted to enhance the visual effectiveness of the superimposition. For example, in one embodiment, the master's image 30 may be a three dimensional graphical rendering, or a photonegative. In other embodiments, the master's image may be enhanced with shadowing, or its pixels may be interlaced with the underlying image.

During operation, student 20 stands on a mat 23 or other suitable surface, and swings the golf club 21 in a normal manner to hit the ball 22. Cameras 15 and 16 begin recording just before the student 20 begins his swing motion, and record continually during the student 20's entire swing motion. In some embodiments, the student 20 or an operator may initiate and terminate recording. In other embodiments, computer 10 is configured to instruct cameras 15 and 16 to begin recording in response to some triggering event such as, for instance, an audio cue, and to terminate recording in response to another triggering event such as, for instance, another audio cue, or the passage of a predetermined period of time. Preferably, the lens characteristics and position of the cameras used to record the master's swing motion are similar to that of cameras 15 and 16 so that the student and master are similarly scaled.

If the student 20 is not satisfied with the swing motion, he may repeat the above process until a suitable swing motion is recorded. If the student 20 is satisfied with the swing motion, the computer 10 captures the most recently recorded swing motion from cameras 15 and 16, and saves the front and side video images as second computer video files in memory 13. The video signals are stored in any well-known video format.

Figure 4:
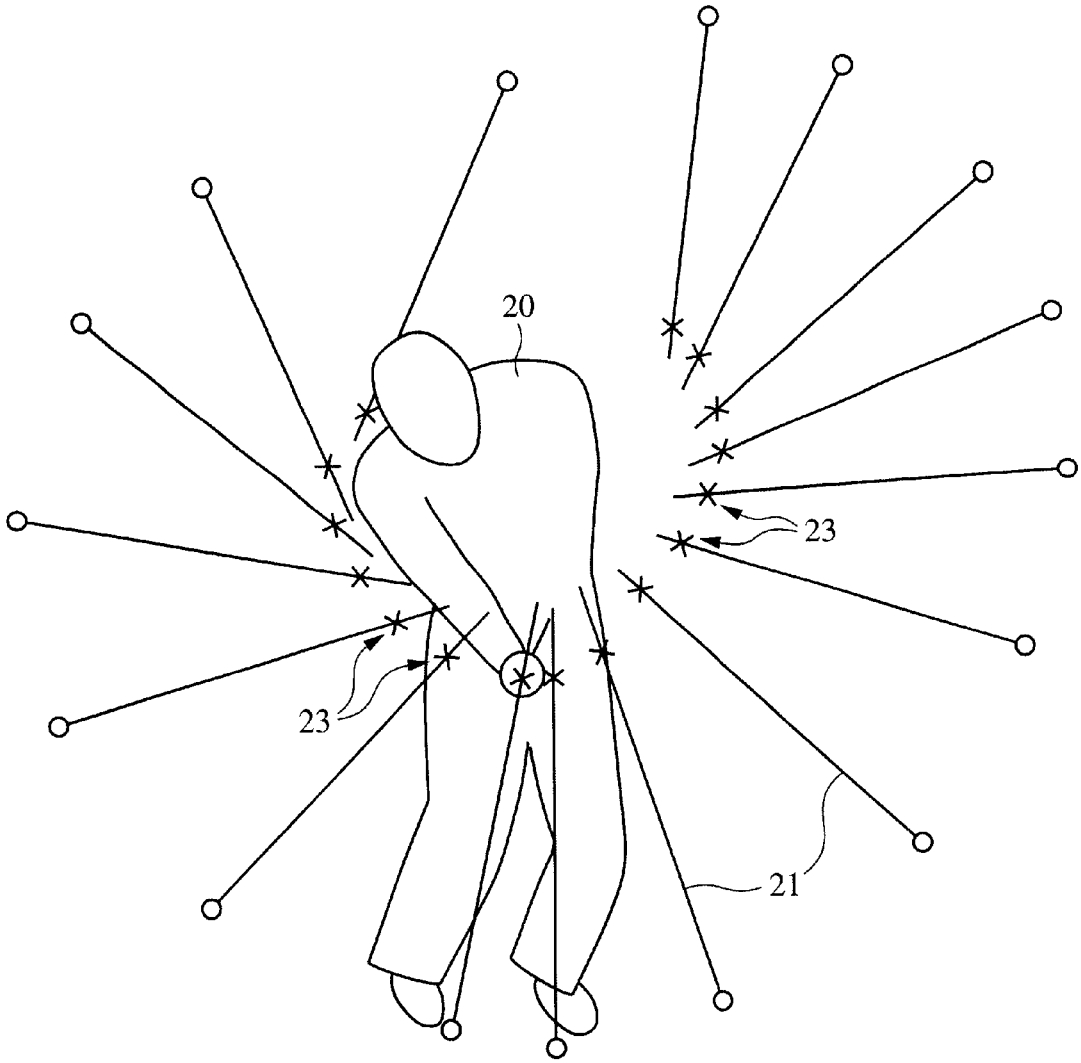
FIG. 4 illustrates time-lapsed progress of a student's swing motion with reference cues inserted according to one embodiment of the present invention.

FIG. 4 shows overlapping frame sequences of the student 20 swinging the club 21 to illustrate motion and relative position of the club 21 and the student 20's wrists during the swing motion. Reference cues 23 are inserted in each frame to indicate the relative position of the student's wrists. In some embodiments, software executing on CPU 11 inserts reference cues 23 to indicate wrist position in each frame sequence using a suitable object selection algorithm. In other embodiments, motion progress may be measured using optical or magnetic recognition techniques. In one embodiment, a tracking device such as a magnetic pin or clip, is attached to the student's wrist or is embedded in the student's glove to enable its tracking during the student's swing motion using well-known positioning software.

Figure 5:
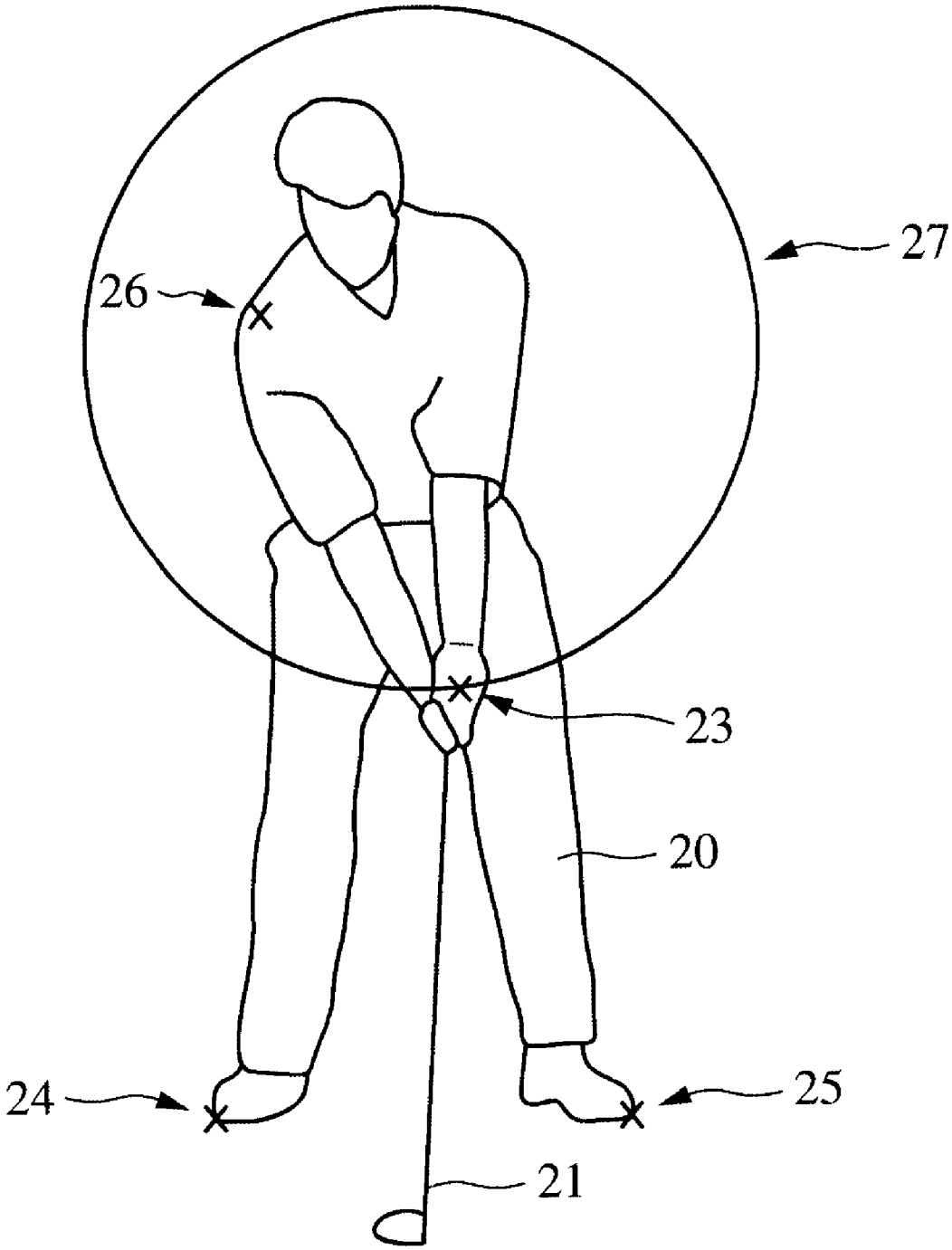
FIG. 5 illustrates tracking of the student's wrist to generate the reference cues shown in FIG. 4 in one embodiment of the present invention.

In other embodiments, where cost is of greater concern, reference cues 23 may be generated manually using a mouse or other positioning input device 17. In one embodiment, CPU 11 plays the video file of the student 20's swing motion on video monitor 14, and enables input device 17 to control positioning of a moveable marker also displayed on monitor 14. At the first frame sequence, the student 20 or an operator positions the marker on the student's wrist as shown, for instance, in FIG. 5. The student or operator also inserts a first alignment cue 24 at the tip of the image 20's right foot, inserts a second alignment cue 25 at the tip of the image 20's left foot, and a third alignment cue 26 on the right shoulder of the image 20, although other alignment cues may be used. The alignment points should be adjustable to enable focused comparisons upon a particular aspect of the swing motion. For example, discrepancies between the hips of the student and master during swing motions may make it difficult to compare the shoulders. In such instances, the shoulders may be used as alignment cues.

Figure 6A:
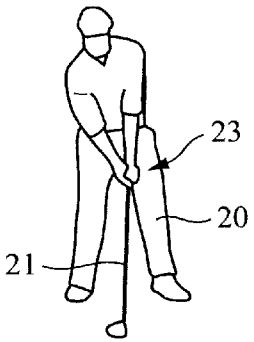
FIGS. 6A–6F illustrate representative frames of the student's swing motion at various intervals, including the reference cues.
Figure 6B:
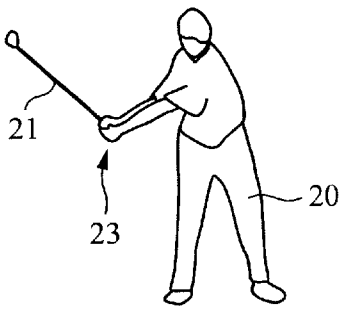
Figure 6C:
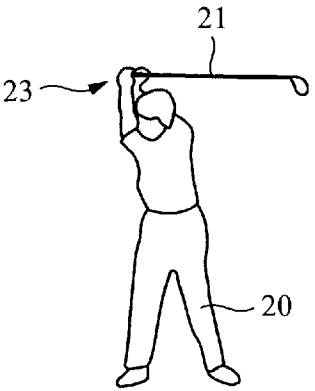
Figure 6D:
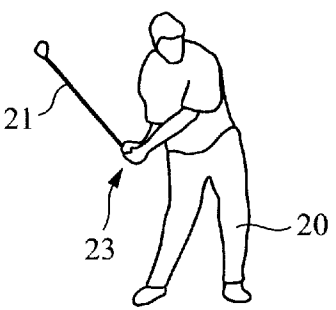
Figure 6E:
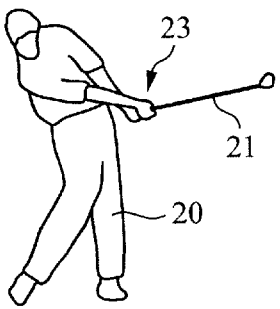
Figure 6F:
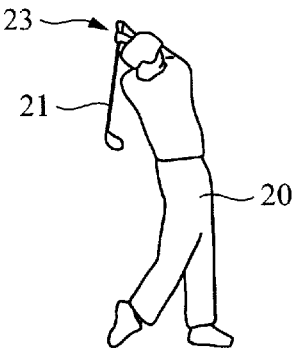

Then, while the student video is displayed on monitor 14, the student or operator traces the movement of the student's wrist during the swing motion with the marker using input device 17 (e.g., using a mouse to trace the path of the wrist). The path 27 traced by the input device 17 depicts motion of the student's wrist during the swing motion, and is used to insert reference cues 23 into corresponding frames of the video as illustrated, for example, in FIGS. 6A–6F, which are exemplary representative frames at various points of the student's swing motion. The frames shown in FIGS. 6A–6F are extracted from the video recording of the student's swing motion in a well-known manner. Specifically, FIG. 6A illustrates the student 20 addressing a golf ball (not shown) with the club 21 at the start of his golf swing. FIG. 6B illustrates the student 20 starting the backswing motion. The backswing continues through FIG. 6B until the student 20 reaches the top of the backswing in FIG. 6C. FIGS. 6D and 6E show the student's downswing through completion of the golf swing motion in the final representative frame in FIG. 6F. Only 6 student frames are shown in FIGS. 6A–6F for simplicity; in actual embodiments, the video recording of the student's swing motion may include 40 or more frames.

The position of the wrists in the student frames may be measured alone, or relative to some predetermined origin point. However, the measurement technique selected for the student frames must be the same as that for the master frames. The origin point may be stationary, or may be defined as some point of the student, e.g., shoulders, midback, etc. If progress of the swing motion is measured only by the position of the wrists, reference cues 23 may include horizontal and vertical coordinate positions of the wrists' location. Alternatively, if progress of the swing motion is measured by the relative position of the wrists and shoulders, reference cues 23 may include information indicating the dynamic angle formed by the intersection of (i) the line connecting the performer's wrists and the midpoint of the shoulders, and (ii) a line running perpendicular to the ground.

A suitable master's swing motion is selected for comparison with the student's swing motion. As mentioned above, computer 10 preferably stores a plurality of masters' swing motions to provide the student with a suitable choice of masters to use for analysis. Once an appropriate master's swing motion is selected, such as that represented in FIGS. 3A–3F, computer 10 superimposes the images of the master's swing motion over corresponding images of the student's swing motion in FIGS. 6A–6F using target cues 32 and reference cues 23 for synchronization. The resultant superimposed frame sequences are displayed as a continuous video, or in slow motion, or interactively frame-by-frame, on monitor 14 to allow for immediate viewing by the student. The video illustrates deviations between the student's swing motion and the master's swing motion that may be analyzed by the student.

Figure 7C:
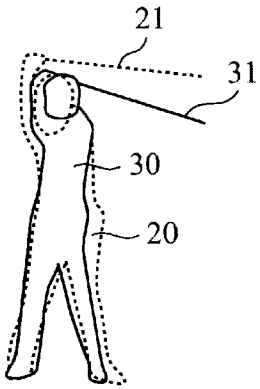
FIGS. 7A–7F illustrate representative frames of the outline of the master's swing motion of FIGS. 3A–3F superimposed upon and synchronized with corresponding frames of the student's swing motion of FIGS. 6A–6F according to one embodiment of the present invention.
Figure 7F:
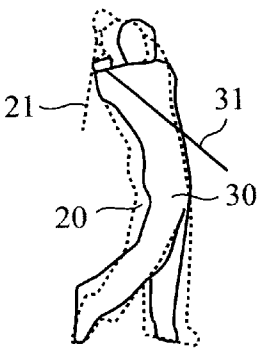
Figure 7B:
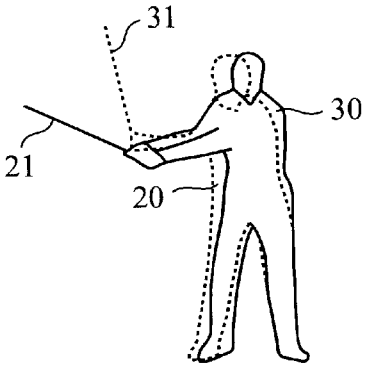
Figure 7E:
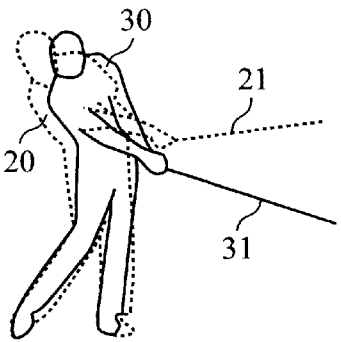
Figure 7A:
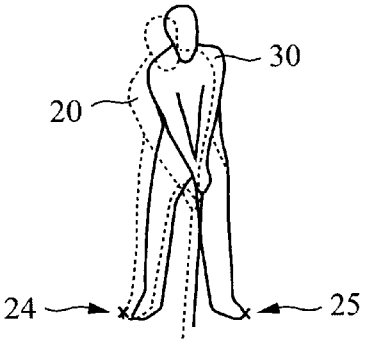
Figure 7D:
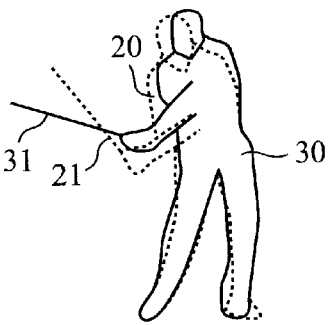

As indicated above, in preferred embodiments, the movement of the wrist is used to synchronize master frames and corresponding student frames by comparing reference cues 23 and target cues 32. In one embodiment, each student frame is matched to a corresponding master frame. For example, the first frame of the student's swing in FIG. 5A, which corresponds to the top of the student's swing, is matched to the first frame of the master's swing in FIG. 3A, which corresponds to the top of master's swing motion. The master's outline 30 of the frame of FIG. 3A is aligned with the student's image 20 using alignments cues 24 and 25, and then superimposed upon the student's image 20 as shown, for instance, in FIG. 7A. Video processing circuit 12 includes a well-known video overlap generator that superimposes the master frame upon the student frame in a well-known manner.

The size of the master's outline 30 is preferably adjusted or normalized to the size of the student's image 20 so as to make the mechanically relevant portions of the master's outline 30 equivalent to the student's image 20. In the preferred embodiment, the mechanically relevant portion of the image is the person's height, excluding the head. Of course, in other embodiments, the mechanically relevant portion of the image may be some other indicia such as, for example, total height of the image. If the video recordings of the master and student are taken from consistent camera angles and zooms and if the motion does not involve movement of the subject's base point as in a student's feet during a golf swing, the normalization parameters used to size the master's outline 30 to the student's image 30 in the first frame (FIG. 7A) may be used to normalize all subsequent frames of the master's swing motion to the student's image 20 size.

Once the normalization parameters are determined, subsequent frames of the student's video are matched and synchronized with corresponding frames of the master's video using the reference 23 and target 32 cues. The resulting superimposition of master frames upon subsequent student frames is shown in FIGS. 7B–7F. These frames form the feedback video that is displayed on monitor 14 for viewing by the student. IN actual embodiments, the resultant feedback video may include 40 or more frames. In some embodiments, areas where the student image does not intersect with the comparison image may be highlighted. In addition to the superimposed image, other reference marks or descriptive text may be superimposed onto the student's image to further highlight differences in swing motion.

As mentioned above, Applicant believes that for actions that involve swinging motions, such as a golf swing, motion progress is best measured by the position of the wrists as indicated, for example, by reference cues 23 and target cues 32. Since each student frame might not find an exact matching frame in the master video, a synchronization algorithm is employed to find the closely matching frames. In the preferred embodiment, the frames may be matched using the progress of the swing motion according to wrist position, as described above. In one embodiment, CPU 11 analyzes each student frame, and selects the closest matching master frame to be superimposed thereon. Thus, each student frame has a single, unique matching master frame, and one or more master frames may be not used. In another embodiment, CPU 11 analyzes each master frame, and selects the closest matching student frame upon which to superimpose. Thus, each master frame has a single, unique matching student frame, and one or more student frames may be not used.

Alternatively, the motion progress of the student's swing and the master's swings may can be synchronized according to time, rather than by comparing positional information of the wrists. Here, each student frame is matched to the master frame that represents the same temporal progress of the swing motion. For example, the student's frame at one second into the swing motion is matched with the master's frame at one second into the motion, regardless of the relative progress of each swing motion.

In some instances, it may be helpful to measure the deviancies between the student's swing motion and the master's swing motion. Standard statistical tools such as mean, median, and standard deviation may be applied to determine the motion deviation, which may be calculated for any one frame, for any segment of the swing motion, or for the entire swing motion. Information generate during the normalization and/or synchronization process(es) described herein may be used to determine motion deviation. The motion deviance for any given frame can be measured by the surface area of the nonintersecting portions of the student and master when one is superimposed upon the other. In embodiments capable of comparing the student's swing motion and the master's swing motion in three dimensions, the motion deviance may be measured by the volume measurement for the nonintersecting portions of the student and comparison performers.

The motion deviance for any given frame can also be measured by comparing distillations of the student and the master. For example, the student and the master may be distilled into simpler geometric shapes, e.g. lines, where the distance between the counterparts for each geometric shape can be measured, or, if the shapes are polygons (or otherwise have depth or breadth), then the motion deviance can be measured by the nonintersecting surface area.

Further, deviancies between specific parts of the student and the master may be weighted differently as desired by the student to reflect the relative importance of body parts. For example, the measured deviance between the student's head and the master's head may be accorded greater weight than deviancies between their knees. If higher deviancies result because the synchronized frames exhibit a substantial difference in motion progress, these higher deviancies from the motion progress criterion may be accorded less weight. Further, deviancies may be adjusted to reflect a selected body part's relative size, e.g. if deviancies are measured by surface area, shoulder deviancies might be adjusted so as to not receive disproportionate weight relative to wrists simply by virtue of the shoulders' size. Moreover, deviancies in different portions of the swing may be accorded different weights. For example, deviancies surrounding the striking of the ball may be accorded more weight than deviancies in the follow-through portion of the swing.

In other embodiments, each student frame may be manually synchronized to a corresponding master frame. Here, after normalizing the master frames to the student frames, the student frames may be sequentially displayed, either automatically after lapse of a predetermined time, or in response to a triggering event provided by an input device (e.g., a mouse "click" or depression of a "hot" key on an associated keyboard). While each student frame is displayed, an operator cycles through and selects the best-matching master frame. The corresponding superimposed master-student frame pairs of then displayed as a continuous video signal on monitor 14 for viewing by the student. Of course, in another embodiment, master frames may be manually matched with corresponding student frames. This manual matching may be accomplished using two separate means to advance or move frames backward. In one embodiment, the means includes two knobs on an input device 17, one controlling succession of the master frames, and the other controlling succession of the student frames. In another embodiment, one axis of mouse movement controls the master frames and an orthogonal axis of mouse movement controls the student frames.

In any embodiment, the automatic synchronization technique employed by the present invention provides a superior training aid in, for example, mastering a golf swing. As explained above, a student seeking to improve his golf swing may record his golf into a first computer video file. CPU 11 inserts reference cues 23 into frame sequences of the student's swing, and then automatically synchronizes the student frames to corresponding, normalized frames of the master's swing. The corresponding frames of the master's swing and the student's swing are superimposed, and thereafter displayed on monitor 14 as a continuous video for immediate viewing by the student. CPU 11 may also include a means for altering the speed of the resultant video displayed on monitor 14 so that the student may discern differences between his swing motion and the master's swing motion in slow motion.

The ability to record the student's video, synchronize it to a master's video, and immediately display the resultant superimposed video to the student makes the present invention ideal for installation at, for example, driving ranges to provide students with immediate analysis of their golf swing. Unlike prior devices, the present invention does not require the student to look at a video monitor while executing his golf swing in a manner to emulate a master's swing, thereby allowing the student to concentrate on executing his swing in a normal manner. Further, since present embodiments provide the superimposed, feedback video directly from computer 11, without having to a make a video tape recording, the student receives immediate, on the spot feedback. After analyzing his swing, the student may immediately record and analyze another swing. Prior training systems that result in the production of a training video typically require the student to view the training tape at a much later time, perhaps at home. Of course, if desired, the feedback video stored in main memory 13 may be recorded onto a video tape using, for instance, a video cassette recorder (VCR) in a well-known manner.

Figure 8:
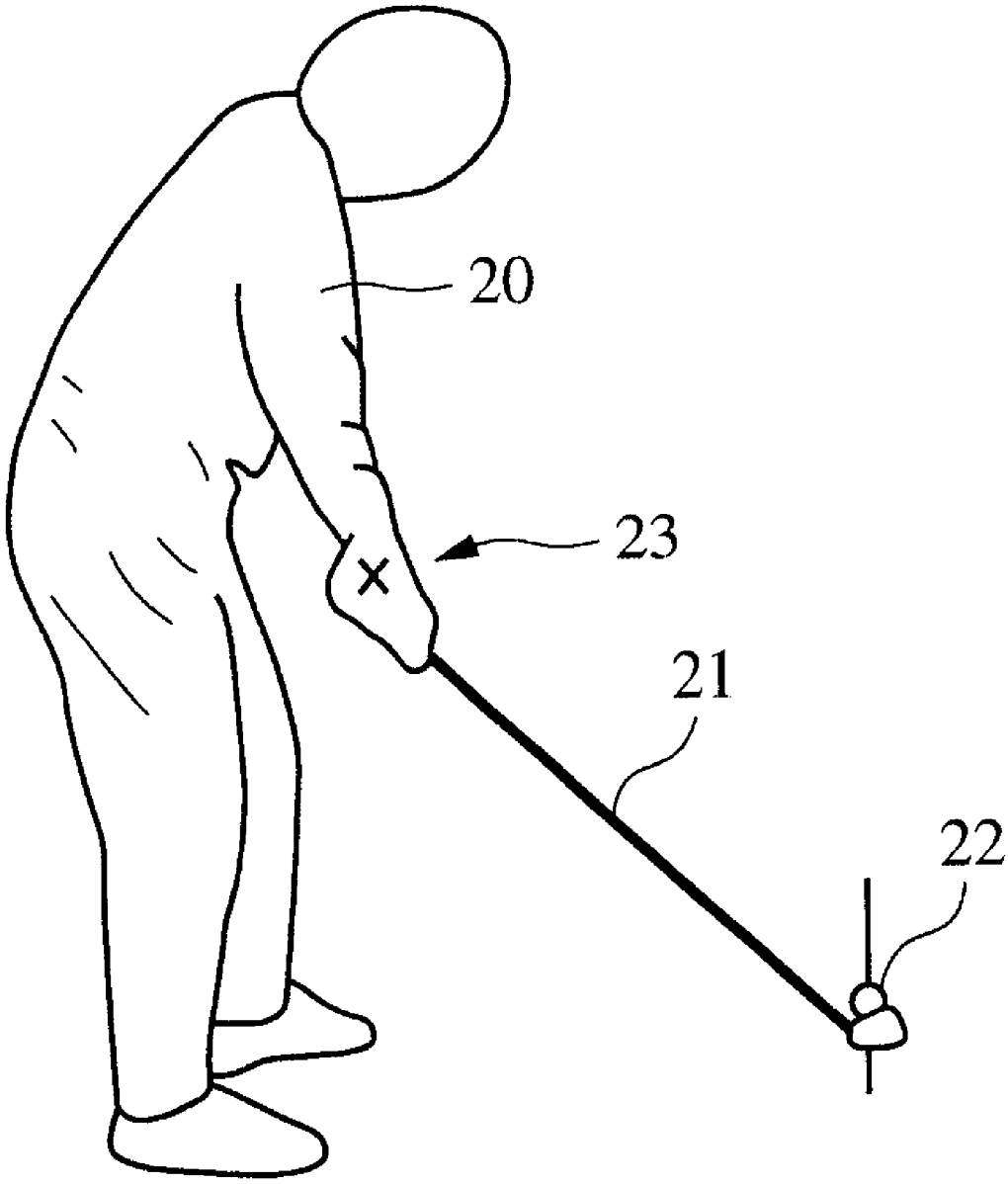
FIG. 8 illustrates side view of the student preparing to swing a golf club.

The present invention has been described above with respect to front view video recordings of the student 20 and master 30. The same techniques are equally applicable to comparing the side view of the student's swing motion, as recorded by side camera 16, to the side view of the master's swing motion. FIG. 8 shows a side view image of the student 20. Initially, CPU 11 determines whether a particular frame sequence corresponds to the front view or the side view by determining the distance between alignment cues 24 and 25 so that the student's swing is compared to the correct view of the master's swing. Alignment cues 24 and 25 correspond to the student's left foot and right foot, respectively, and are thus much closer together in the side view (e.g., FIG. 8) than in the front view (e.g., FIG. 4). Then, CPU 11 synchronizes and superimposes corresponding master frames and student frames in the manner described above to generate a continuous video illustrating differences between the master's swing and the student's swing.

However, in the side view recorded by side camera 16, the position of the student's wrist may overlap in multiple frames during the swing motion, thereby rendering matching correlations difficult to discern. For example, the position of the wrists during the backswing, downswing, and follow-through may overlap when viewed from side camera 16. Thus the backswing, downswing, and follow-through should each be accorded its own segment. Thus, in one embodiment, master and student frames are divided into groups corresponding to the backswing, the downswing, and the follow-through to ensure that master frames corresponding to the backswing are synchronized with student frame corresponding to the backswing, that master frames corresponding to the downswing are synchronized with student frame corresponding to the downswing, and so on. Thus, the progress of any given frame may be ordered first by group (e.g., downswing), and then ordered by the progress criteria (e.g., the position of the wrists).

In some embodiments, the resulting front view and side view superimposed videos are displayed simultaneously in a side-by-side fashion on monitor 14. If the output for more than one perspective is viewed simultaneously, the motion progress of the perspectives may be synchronized to each other. In one embodiment, the frames are be synchronized by matching the motion progress measurements for a common dimension between the perspectives. For example, the vertical (y) dimension of the perspectives is common to both the perspectives of a golf swing. This allows the frames of one perspective to be matched to already synchronized frames pairs of the other perspective. In another embodiment, the master frames from one perspective may be matched to the master frames of the other perspective prior to motion analysis synchronization.

To further enhance synchronization accuracy, interpolation or ratcheting may be implemented where the swing motion is a relatively smooth motion. For example, in golf, once a swing has progressed about a third of the way to completion, it is unlikely that the motion will be suspended or reversed as part of a normal performance. Thus, synchronization based upon motion progress (e.g., wrist movement tracking) may be interpolated or ratcheted based on the measurements of surrounding frames in a well-known manner. Similarly, the master frame corresponding to a given student frame may be interpolated or ratcheted based on temporally proximate master-student frame pairs. The interpolations may be linear or based on a function calculated to include the positions of surrounding frames most closely.

The interpolation or ratcheting techniques may be absolute or based on confidence thresholds for the current or surrounding student frames. For example, a frame may be interpolated or ratcheted if certain indices suggest that the progress determinations for surrounding frames were more accurate than that of the current frame. These indices might be based on (i) the confidence accorded to a frame's positional measurements, e.g. based on the recognition strength suggested by optical or magnetic measurements, or (ii) the consistency of the measurements for the current frame and surrounding frames (e.g. the consistency of the speed and acceleration reflected in the current and surrounding frames), (iii) whether the progress criteria of the student frames are clustered relative to the master frames, (iv) or any combination of these.

Sometimes, at the very beginning of the swing, a student may move their clubs slightly forward and backward in what is commonly referred to as a "waggle." In such instances, interpolation and ratcheting may be disabled during this part of the student's swing.

Figure 9B:
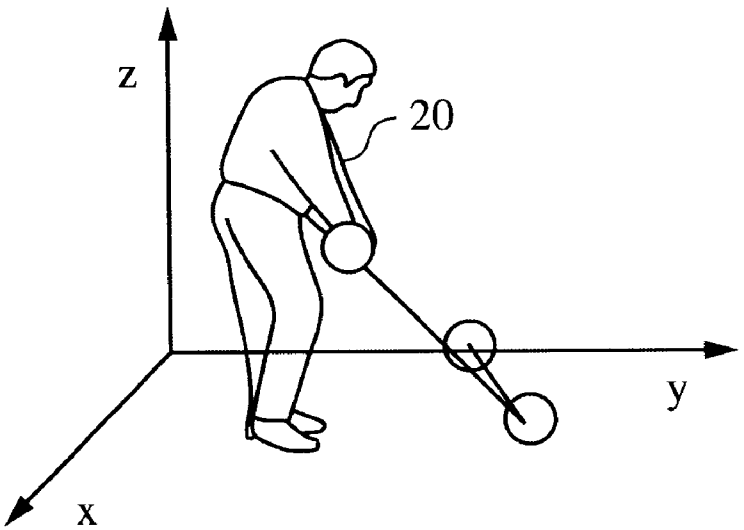
FIG. 9B illustrates side front view of a student with respect to x, y, and z dimensions.
Figure 9A:
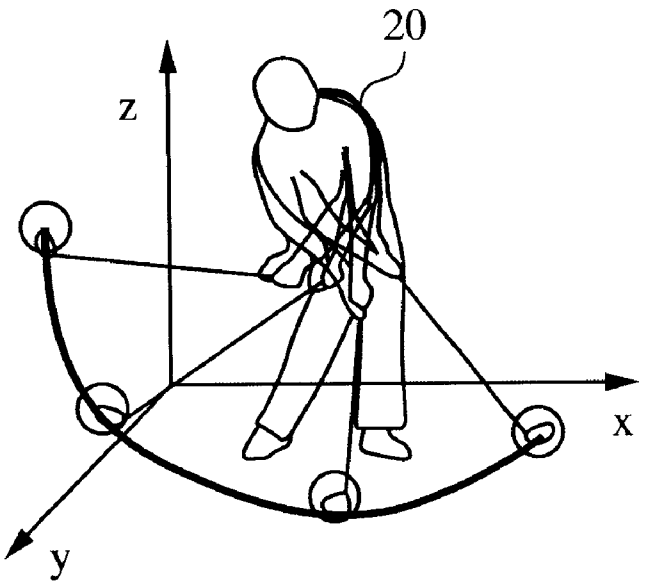
FIG. 9A illustrates a front view of a student with respect to x, y, and z dimensions.

In some embodiments, analysis of the path, orientation, and speed of the active object is used to predict the effect of the swing motion. For example, the path, orientation, and speed of the clubhead in a golf swing may be useful to predict the ball's flight trajectory, spin, etc. To ensure proper scaling, the tracking measurements are calibrated against known reference points in the video. For example, in a golf swing, the length of the club or the height of the golfer may be used to scale the object's tracking measurements. The object's tracking measurements for each dimension of each camera angle is calculated as a function of time according to one or more polynomials that ensure that the function creates a curve that approximates the student's motion and passes through the known tracking measurements of the active object for each frame. For example, in the front view depicted in FIG. 9A, tracking measurements of the club path are defined as a function of the x and z dimensions, and similarly, for the side view depicted in FIG. 9B, tracking measurements of the club path is defined as a function of the y and z dimensions. Alternatively, at least one dimension of tracking measurement may be defined as a function of time and one of the other dimensions.

Because tracking measurements for any dimension may overlap as part of the motion, if a dimension is calculated as a function of another dimension, time-defined function should be used to ensure that the function yields a single output for any input. When the available camera angles yield overlapping dimensional data, the function(s) for the overlapping data can be developed from any single angle or from any combination (e.g. weighted averages) of the overlapping data. The measurements for any overlapping dimensions should be normalized to ensure that the dimensional scales are equivalent. For example, FIGS. 9A and 9B each yield measurements for the z dimension. Accordingly, the z tracking measurements should be combined for the two angles. The scales for the z measurements may be normalized based on the student's height or the length of the club and identifying a common point (e.g. the ball) or range (e.g. the maximum and minimum z tracking values). The formula for z as a function of time might be calculated by averaging the normalized z values for any given time in the motion. The average could be weighted based on confidence levels for any given measurement or angle.

In calculating path functions, data may include any known measurements for points through which the object must pass, whether or not those points are reflected in the actual frames. The time or other dimensional element for those points can be interpolated from surrounding frames or the speed function described below. For example, if the student hits the ball or is assumed to hit the ball, the clubhead tracking measurements may include the location of the ball as a data point in determining the path function, whether or not a frame actually contains the clubhead at the point of impact.

If the point of impact is stationary, as in golf, the time of impact can be determined by finding the point at which path functions for each dimension intersect the location of the ball. If the point of impact is not stationary, e.g., as in tennis or baseball, the striking instrument and the ball should each be tracked as an active object. The time and point of impact will be when the instrument's path function for each dimension intersects the path function for each dimension of the ball.

The active object's speed may be calculated as function of time based on the path functions for the object. The active object's speed at the point of impact can be determined by looking at the path function at the time of impact. Similarly to its path, the object's orientation may be calculated as an angle for each of three axes (i.e., pitch, yaw, and roll) versus time. The function may use one or more polynomials or another formula as necessary to ensure that the function approximates the performer's motion and passes through the known tracking measurements of the active object for each frame. For example, in measuring the orientation of a clubhead for a golf swing, pitch can be derived from the clubhead's appearance or the slope of the club from the front view camera angle. Roll can be derived from the clubhead's appearance or the slope of the club from the side view camera angle. Yaw can be derived either from the clubhead's appearance, or calculations based on the actual length of the club, the visible length of the club in the frame, the camera's lens characteristics, and the distance from the club determined by looking at the function at the time of impact. In addition, a reference object with known and visibly differentiated features may be attached to the object to assist in measuring its orientation.

It may also be helpful in determining the function for path to include known effects of motion characteristics. For example, if a golf swing is identified from the frames as being "outside-in," the determination of the path, orientation, and speed functions may be adjusted to reflect the path characteristics generally associated with outside-in swings. Such adjustments may be weighted for the extent of the identified characteristics and for confidence in the recognition measurements.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

I claim:

1. A method of analyzing a student's swing motion using a computer, comprising the steps of:

pre-recording a master's swing motion in a first computer file;

recording the student's swing motion into a second computer file;

tracking the position of a reference cue associated with the student during the student's swing motion;

synchronizing the master's swing motion to the student's swing motion using the reference cue;

superimposing the master's swing motion onto the student's swing motion to create a feedback video; and displaying the feedback video to the student.

2. The method of claim 1, wherein the reference cue indicates a position of the student's wrist during the student's swing motion.

3. The method of claim 2, further comprising:

normalizing the master's swing motion to the student's swing motion.

4. The method of claim 1, wherein:

the first computer file comprises a plurality of first frames depicting the successive progress of the master's swing motion, each first frame including a target cue indicative of the position of the master's wrist in the corresponding first frame; and the second computer file comprises a plurality of second frames depicting successive progress of the student's swing motion, each second frame including the reference cue indicative of the position of the student's wrist in the corresponding second frame.

5. The method of claim 4, wherein the synchronizing step comprises:

comparing, for each of the second frames, its reference cue to respective target cues of the first frames to generate synchronization data; and selecting, for each of the second frames, a corresponding first frame to be superimposed upon the second a frame using the synchronization data derived in the comparing step.

6. The method of claim 5, wherein the first and second frames are each divided into two or more groups corresponding to different portions of a swing motion, the second frames in a particular group being synchronized only with first frames in the particular group.

7. The method of claim 6, wherein the groups comprise a back-swing portion, a down-swing portion, and a follow-through portion of the swing motion.

8. The method of claim 5, wherein the tracking step comprises:

providing a positioning marker on a video monitor of the computer;

displaying the student's swing motion as a continuous video on the video monitor; and moving the positioning marker on the video monitor while displaying the continuous video so as to track motion of the student's wrist during the student's swing motion.

9. The method of claim 8, wherein the moving step is performed using a mouse.

10. The method of claim 8, wherein the moving step is performed using a touchpad.

11. The method of claim 5, wherein the tracking step comprises:

providing a tracking device on the student's wrist when recording the student's swing motion; and tracking motion of the tracking device during the student's swing motion.

12. The method of claim 11, wherein the tracking device comprises an optical device.

13. The method of claim 11, wherein the tracking device comprises a magnetic glove.

14. The method of claim 5, wherein the tracking, superimposing, and synchronizing steps are performed by a microprocessor.

15. A computer system configured to allow for comparison of a student's swing motion to a master's swing motion, comprising:

means for recording the master's swing motion in a first computer file;

means for recording the student's swing motion into a second computer file;

means for tracking motion of a reference cue associated with the student during the student's swing motion;

means for synchronizing the master's swing motion to the student's swing motion using the reference cues associated with the student's swing motion;

means for superimposing the master's swing motion onto the student's swing motion to create a feedback video; and means for displaying the feedback video to the student.

16. The system of claim 15, wherein the reference cue indicates a position of the student's wrist during the swing motion.

17. The system of claim 15, wherein:

the first computer file comprises a plurality of first frames depicting the progress of the master's swing motion, each first frame including a target cue indicative of the position of the master's wrist in the corresponding first frame; and the second computer file comprises a plurality of second frames depicting successive progress of the student's swing motion, each second frame including the reference cue indicative of the position of the student's wrist in the corresponding second frame.

18. The system of claim 15, wherein the means for synchronizing comprises:

means for comparing, for each of the second frames, its reference cue to respective target cues of the first frames to generate synchronization data; and means for selecting, for each of the second frames, a corresponding first frame to be superimposed upon the second frame using the synchronization data derived in the comparing step.

19. The method of claim 18, further comprising:

means for grouping the first and second frames into two or more groups corresponding to different portions of a swing motion; and means to synchronize the second frames in a particular group only with first frames in the particular group.

20. The system of claim 19, wherein the groups compromise a back-swing portion, a down-swing portion, and a follow-through portion of the swing motion.

21. The system of claim 15, wherein the means for tracking comprises:

means for providing a positioning marker on a video monitor of the computer;

means for displaying the student's swing motion as a continuous video on the video monitor; and means for moving the positioning marker on the video monitor while displaying the continuous video so as to track motion of the student's wrist during the student's swing motion.

22. The system of claim 21, wherein the means for moving comprises a mouse.

23. The system of claim 21, wherein the means for moving comprises a touchpad.

24. The system of claim 15, further comprising:

means for providing a tracking device on the student's wrist when recording the student's swing motion; and tracking motion of the tracking device during the student's swing motion.

25. The system of claim 24, wherein the tracking device comprises optical device.

26. The system of claim 24, wherein the tracking device comprises a magnetic glove.

27. The system of claim 15, wherein the means for tracking, superimposing, and synchronizing comprise a microprocessor.

28. A method of synchronizing a motion video of a student's swing motion with a motion video of a master's swing motion using a computer, comprising:

providing, in the motion video of the student's swing motion, a reference cue indicating positional information of the student during the student's swing motion;

providing, in the motion video of the master's swing motion, a target cue indicating positional information of the master during the master's swing motion; and aligning the reference cue and the target cue to synchronize the motion video of the student's swing motion to the motion video of the master's swing motion to create a comparison video.

29. The method of claim 28, wherein the positional information of the student comprises the student's wrists and the positional information of the master comprises the master's wrists.

30. The method of claim 29, wherein the motion video of the student's swing motion comprises a first computer file having a plurality of first frames depicting progress of the student's swing motion, and the motion video of the master's swing motion comprises a second computer file having a plurality of second frames depicting progress of the master's swing motion.

31. The method of claim 29, further comprising:

displaying the comparison video to the student.

32. The method of claim 31, wherein the student's and master's swing motions comprise golf swings.

33. The method of claim 30, further comprising:

inserting the reference cue into each of the first frames of the motion video of the student's swing motion; and inserting the target cue into each of the second frames of the motion video of the master's swing motion.

34. The method of claim 30, wherein inserting the reference cue into the motion video of the student's swing motion comprises:

providing a positioning marker on a video monitor of the computer;

playing the motion video of student's swing motion on the video monitor; and moving the positioning marker on the video monitor so as to track the student's wrist during the playing of the motion video.

35. The method of claim 34, wherein the moving step is performed using a mouse.

36. The method of claim 34, wherein the moving step is performed using a touchpad.

37. The method of claim 30, wherein inserting the reference cue into the motion video of the student's swing motion comprises:

attaching a tracking device on the student's wrist;

recording the motion video of the student's swing motion with the tracking device attached to the student's wrist; and tracking motion of the tracking device during the student's swing motion.

38. The method of claim 37, wherein the tracking device comprises an optical device.

39. The method of claim 37, wherein the tracking device comprises a magnetic glove.

40. The method of claim 30, wherein the superimposing step comprises:

comparing, for each of the first frames, its reference cue to respective target cues of the second frames to generate synchronization data; and selecting, for each of the first frames, a corresponding second frame to be superimposed thereon using the synchronization data.

41. The method of claim 29, wherein the aligning step comprises:

comparing, for each of the second frames, its target cue to respective reference cues of the first frames to generate synchronization data; and selecting, for each of the second frames, a corresponding first frame to be superimposed upon using the synchronization data.

42. A computer system configured to generate a comparison video highlighting differences between a student's swing motion and a master's swing motion, comprising:

means for superimposing a motion video of the student's swing motion onto a motion video of the master's swing motion using a synchronization between a reference cue associated with the student and a target cue associated with the master to generate the comparison video, wherein the reference cue identifies the position of the student's wrist during the student's swing motion, and the target cue identifies the position of the master's wrist during the master's swing motion.

43. The computer system of claim 42, wherein the motion video of the student's swing motion comprises a first computer file having a plurality of first frames depicting progress of the student's swing motion, and the motion video of the master's swing motion comprises a second computer file having a plurality of second frames depicting progress of the master's swing motion.

44. The computer system of claim 43, further comprising:

a video monitor for displaying the comparison video to the student.

45. The computer system of claim 43, further comprising:

means for inserting the reference cue into each of the first frames of the motion video of the student's swing motion; and means for inserting the target cue into each of the second frames of the motion video of the master's swing motion.

46. The computer system of claim 45, wherein the means for inserting the reference cue into the motion video of the student's swing motion comprises:

means for providing a positioning marker on a video monitor;

means for playing the motion video of student's swing motion on the video monitor; and means for moving the positioning marker on the video monitor so as to track the student's wrist during the playing of the motion video.

47. The computer system of claim 46, wherein the means for moving comprises a mouse.

48. The computer system of claim 46, wherein the means for moving comprises a touchpad.

49. The computer system of claim 45, wherein the means for inserting the reference cue into the motion video of the student's swing motion comprises:

a tracking device attached to the student's wrist;

means for recording the student's swing motion; and means for tracking motion of the tracking device during the student's swing motion.

50. The computer system of claim 49, wherein the tracking device comprises an optical device.

51. The computer system of claim 49, wherein the tracking device comprises a magnetic glove.

52. The computer system of claim 43, wherein the means for superimposing comprises:

means for comparing, for each of the first frames, its reference cue to respective target cues of the second frames to generate synchronization data; and means for selecting, for each of the first frames, a corresponding second frame to be superimposed thereon using the synchronization data.

53. The computer system of claim 43, wherein the superimposing step comprises:

means for comparing, for each of the second frames, its target cue to respective reference cues of the first frames to generate synchronization data; and means for selecting, for each of the second frames, a corresponding first frame to be superimposed upon using the synchronization data.

* * * * *